United States Patent [19]

Bolieau

[11] Patent Number: 4,574,699

[45] Date of Patent: Mar. 11, 1986

[54] EXTENDIBLE WAFER IGNITER WITH PERFORATIONS ADJACENT THE FOOT PORTION

[75] Inventor: Christopher W. Bolieau, Brigham City, Utah

[73] Assignee: Thiokol Corporation, Chicago, Ill.

[21] Appl. No.: 552,650

[22] Filed: Nov. 17, 1983

[51] Int. Cl.[4] ..... F42B 15/10

[52] U.S. Cl. ..... 102/202; 102/205; 102/287; 102/380; 60/256

[58] Field of Search ..... 102/202, 205, 287, 380; 60/256

[56] References Cited

U.S. PATENT DOCUMENTS

| | | | |
|---|---|---|---|
| 3,143,853 | 8/1964 | Sobey | 60/256 X |
| 3,324,656 | 6/1967 | Bradshaw | 102/202 X |
| 3,332,353 | 7/1967 | Burkardt et al. | 60/256 X |
| 3,392,673 | 7/1968 | King | 60/256 X |
| 3,581,662 | 6/1971 | Grebert et al. | 102/202 |
| 3,667,396 | 6/1972 | Barrett | 102/202 |
| 4,378,674 | 4/1983 | Bell | 102/202 X |
| 4,498,292 | 2/1985 | White | 60/256 |
| 4,503,773 | 3/1985 | Bolieau | 102/202 |

*Primary Examiner*—Peter A. Nelson

*Attorney, Agent, or Firm*—Gerald K. White

[57] ABSTRACT

A closed urethane cylindrical case includes a mounting base or foot which runs parallel to the axis of the case and is bonded to the surface of the propellant grain of a full head-end-web rocket motor. Contained within the case are one or more spaced tube initiators and concentrically positioned discs or webs of high energy propellant. Flaming gases resulting from actuation of the tube initiators and consequent burning of the propellant wafers are projected over the surface of the rocket motor propellant from a plurality of nozzle ports that are provided in the cylindrical case, in the quadrants thereof adjacent the surface of the rocket motor propellant. Cylindrical case length and the number of tube initiators and propellant wafers including their spacing can be selected as required to achieve a desired mass flow rate.

10 Claims, 6 Drawing Figures

EXTENDIBLE WAFER IGNITER WITH PERFORATIONS ADJACENT THE FOOT PORTION

The government has rights in this invention pursuant to Contract No. FO4611-82-C-0045 awarded by the U.S. Air Force.

BACKGROUND OF THE INVENTION

1. Field of the Invention

The present invention relates to an improved igniter for solid fuel rocket motors and has particular utility in high performance solid fuel rocket motors having full, head-end-web propellants.

2. Description of the Prior Art

The conventional igniter for large solid fuel rocket motors is a miniature rocket motor that is known in the art as a "pyrogen" igniter. Typically, a pyrogen igniter is mounted in the forward end of a motor through a hole in the propellant. In some high-performance rocket motors, however, a pyrogen igniter is impractical to use because of the full, head-end-web of the propellant in the forward end of the motor. The head-end-web propellant grain design has the primary advantage of providing a higher mass fraction.

Full, head-end-web solid propellant rocket motors are now being developed which have the capability of being offloaded, that is, having some of the propellant grain removed to meet specific total impulse requirements. Such offloading is achieved by machining out propellant from the aft end of the motor. As the propellant is removed, the internal free volume of the motor increases proportionately. The larger free volume makes ignition of the motor more difficult. One way to improve the ignition process is to mount the igniter to the aft surface of the motor propellant grain. The source of heat for ignition thus remains as close as possible to the surface being ignited, regardless of the degree of offload.

Mounting the igniter to the motor propellant grain introduces a problem. This is because, upon ignition and burning of the propellant grain at the aft end of the motor, the support for the igniter erodes. Such erosion tends to cause the igniter to become detached from the propellant grain with possible resulting damage to the rocket motor nozzle and/or the propellant. In order to avoid such damage, the igniter must be substantially consumed before becoming detached from the propellant grain. Additionally, the igniter must perform its intended function of igniting the propellant grain before being consumed. A further requirement is that the igniter must exhaust or project its output across the surface of the motor propellant surface regardless of the percent of offload.

In a form of igniter for high-performance solid fuel rocket motors proposed in the prior art, as disclosed in the copending application for patent of C. Max White bearing Ser. No. 463,102 filed Feb. 2, 1983, now U.S. Pat. No. 4,498,291, and assigned to Thiokol Corporation, the assignee of the present invention, there is provided a consumable wafer-like igniter comprising cylindrical hat-shaped housing with a projecting rim or flange. The flange is bonded to the surface of the motor propellant grain, and being so bonded, forms the igniter chamber. A problem with this igniter is that the internal or chamber pressure of the igniter tries to force the igniter off the surface of the motor propellant grain.

Thus, the allowable igniter internal pressure is dependent upon the integrity of the bond between the igniter flange and the surface of the propellant grain. Another problem with this igniter stems from the internal volume thereof being fixed and difficult to adjust and is manifested as an instability, known in the art as the "L*" instability. This is a phenomenon that tends to occur when the igniter is fired in a very large vacuum chamber. The instability is encountered in this situation when the free volume of the igniter chamber is too small. Specifically, when the igniter chamber is too small, minor variations in igniter chamber volume can cause an oscillation in the rate of burning of the igniter propellant and resulting extinguishment thereof.

Another form of igniter for high-performance solid fuel rocket motors is disclosed in my copending application Ser. No. 453,318, filed Dec. 27, 1982, now U.S. Pat. No. 4,503,773, and assigned to Thiokol Corporation. This igniter comprises a closed pressure vessel that is attached to a lined cutout or cavity in the surface of the motor propellant grain. It does not depend upon a bond between the surface of the motor propellant grain and the igniter to hold the igniter internal pressure. That is to say, the thrust of the igniter is neutral so that it neither applies stresses to the motor propellant nor tries to eject the igniter from the cavity. The liner for the cavity may be machinable with the aft end of the motor propellant grain so that propellant grain cut back can readily be achieved to accommodate, as required, a change in mission of the motor. The need for a cavity and a liner therefor for attaching the igniter to the motor propellant grain introduces an aspect of complexity and cost that indicates a need for further improvements in high-performance rocket motor igniters that are intended for use in vacuum space.

SUMMARY OF THE INVENTION

An object of the invention is to provide an improved consumable igniter, the internal volume of which can easily be adjusted to eliminate the L* instability, for igniting solid fuel rocket motors having full, head-end webs.

Another object of the invention is to provide an improved consumable wafer igniter for such solid fuel rocket motors which, in operation, is attached to the surface of the motor propellant grain, and is characterized in that the internal pressure of the igniter does not try to pull the igniter off the motor propellant grain surface.

A further object of the invention is to provide such an improved wafer igniter wherein the igniter pressure vessel is not dependent on the bond of the foot or mounting base thereof to the motor propellant grain surface.

Still another object of the invention is to provide such an improved wafer igniter the basic structure of which is such as to be readily extendible when manufactured and in which the operating pressure and the loads on case bonds, propellant bonds and all structural parts remain the same, independent of total mass flow.

Another object of the invention is to provide such a wafer igniter in which the basic shape of the igniter is the same in both the pressurized and unpressurized state.

In accomplishing these and other objectives of the invention, there is provided a wafer igniter for projecting a stream of flaming gases onto the surface of the propellant grain of a rocket motor comprising a consumable, cylindrical case with an external foot that is bonded to the motor propellant grain surface. In a first illustrated embodiment of the invention, three wafers or circular discs of propellant are provided in spaced concentric relation within the cylindrical case with a tube initiator positioned in uniformly spaced relation between each of the end wafers and the central wafer. The cylindrical case is sealed at each end, and is provided with two rows of nozzle ports or perforations in each of the third and fourth quadrants thereof, that is, the quadrants adjacent to the propellant grain. As a result, upon ignition of the propellant wafers, flaming gases are projected from the rows of nozzle ports with a component of flow in the direction of the foot. Some, at least, of the ports, face an open area internally of the cylindrical case, between the propellant wafers.

In a second illustrated embodiment of the invention, two circular discs or wafers of propellant are provided in spaced concentric relation within a consumable cylindrical case, the ends of which are sealed. A single tube initiator is positioned in uniformly spaced relation with the propellant wafers. Two rows of nozzle ports are provided in each of the third and fourth quadrants of the case with each port facing an open area internally of the case, between the propellant wafers.

As those skilled in the art will understand, the invention is not limited to the illustrated embodiments. An igniter with but a single wafer and initiator may be provided in a shortened cylindrical case, or additional case length, wafers and initiators can be added to increase mass flow rate.

BRIEF DESCRIPTION OF THE DRAWINGS

Having summarized the invention, a detailed description follows with reference being made to the accompanying drawings which form part of the specification, of which.

DESCRIPTION OF THE PREFERRED EMBODIMENTS

Figure 1:
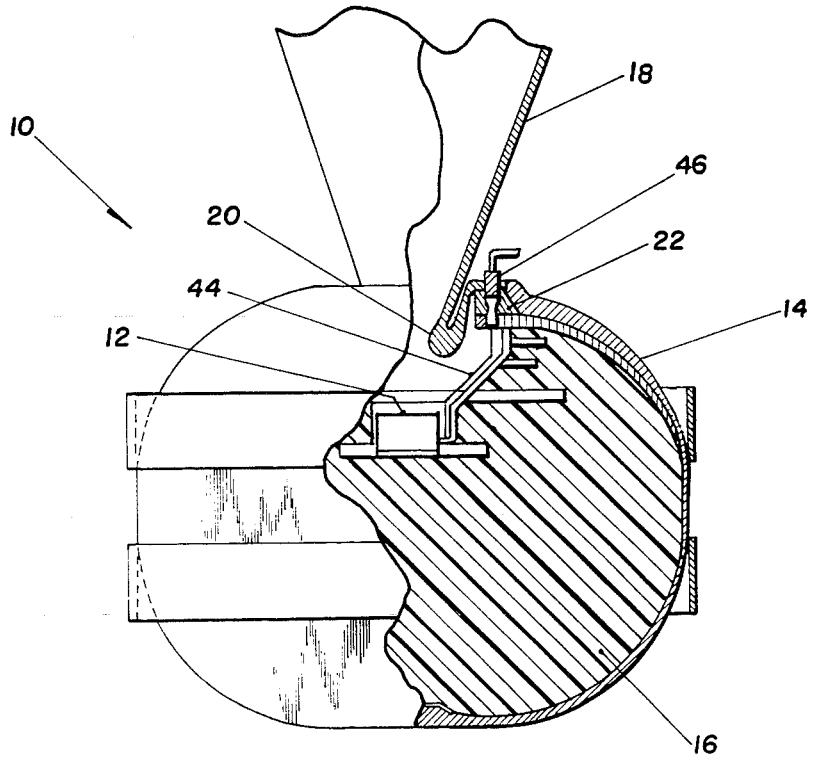
FIG. 1 is a cross-sectional view showing the igniter of the present invention installed in a high-performance rocket motor having a full, head-end-web propellant grain.

Referring to FIG. 1 of the drawings, the numeral 10 designates a high performance rocket motor in which a wafer igniter 12 according to the present invention is installed. The rocket motor 10 includes a rocket case 14 containing a rocket propellant 16. The propellant 16 comprises a full head-end-web propellant grain, and as shown in FIG. 1, may substantially completely fill the head or forward end of the rocket motor case 14. As described with reference to FIG. 6 herein, however, propellant cutback can readily be achieved with the wafer igniter of the present invention to accommodate, as required, a change in mission of the rocket motor. Cutback is usually effected before an igniter has been installed. The igniter of the present invention is removable if a mission change requires cutback. The rocket motor 10 further includes a semisubmerged nozzle 18 of the convergent-divergent type having a throat 20. The nozzle 18 is attached to the case 14 by a 20 polar boss 22.

Figure 2:
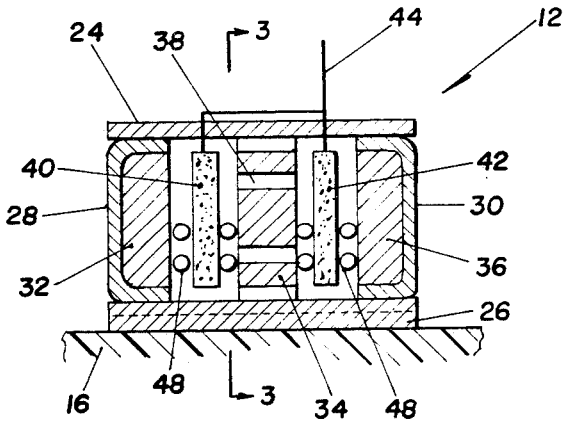
FIG. 2 is a cross-sectional view of a first embodiment of the igniter of the invention.
Figure 3:
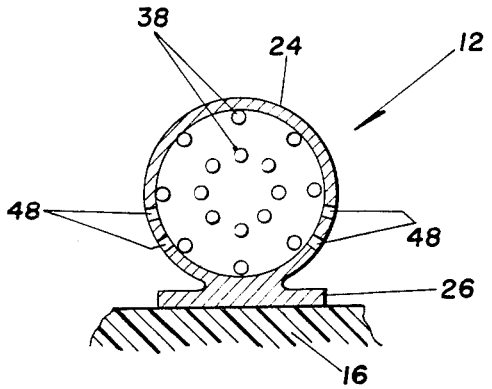
FIG. 3 is a cross-sectional view taken along the lines 3—3 of FIG. 2.

As shown in FIGS. 2 and 3, the wafer igniter 12 includes a cylindrical case 24, which may be made of urethane or other suitable material such as aramid polymer fiber filament. An aramid polymer that is suitable for this purpose is available commercially from E. I. DuPont de Nemours, Wilmington, Del., under the trademark KEVLAR. Case 24 has an external foot 26 that extends longitudinally of the case 24 and is bonded to the surface of the propellant grain 16. First and second urethane closures or end caps 28 and 30 are bonded to a respectively associated one of the opposite ends of case 24. Igniter 12 thus comprises a closed, rigid pressure vessel that does not depend upon a bond between the propellant grain 16 and the foot 26 to hold the igniter pressure.

Contained within the cylindrical case 24 are first, second and third spaced propellant discs or wafers 32, 36 and 34, respectively. Thus, first wafer 32 is contained within and conforms to the shape of the cup-shaped closure 28. Similarly, second wafer 36 is contained within and conforms to the shape of the cup-shaped closure 30. Third wafer 34 is positioned within case 24 intermediate of and spaced from each of the other two wafers 32 and 36. The outer diameter of the wafer 34 may be substantially the same as the internal diameter of case 24, wafer 34 being bonded in place within case 24. This serves to inhibit burning of those surfaces that touch case 24. A plurality of perforations 38 formed in wafer 34 serve to equalize the pressure inside the igniter and provide extra surface area for better burning, that is, to produce the required burning surface to support a specific mass flow rate. Perforations 38 desirably are distributed uniformly in wafer 34, as illustrated in FIG. 3. A first tube initiator 40 is provided in case 24 in the region between propellant wafers 32 and 34. A second, similar tube initiator 42 is provided in the region between the propellant wafers 34 and 36. Initiators 40 and 42 are held in position by suitable means, not shown, and may each be of the type described in my aforementioned copending application for patent bearing Ser. No. 06/453,318. Each of initiators 40 and 42 includes a urethane housing containing a booster charge and a Hivelite fuze that is connected by a Hivelite lead 44 originating at a through bulkhead initiator 46, as seen in FIG. 1. A Hivelite fuze is a product of Teledyne McCormick-Selph, 3601 Union Road, P. O. Box 6, Hollister, Calif.

The cylindrical case 24 is formed with a plurality of nozzle ports or perforations 48 that are distributed in four longitudinal rows, as shown in FIGS. 2 and 3. That is to say, two such parallel rows of ports 48 are formed in each of the third and fourth quadrants of the case 24. As shown, a substantial number of the nozzle ports 48 face an open region between the propellant wafers 32, 34 and 36, internally of case 24. Nozzle ports 48 project a stream of flaming gases from the burning propellant wafers onto and across the adjacent surface of the rocket motor propellant 16.

For sustaining ignition in a vacuum (high altitude) environment, the material of which the propellant wafers 32, 34 and 36 is made preferably is a high-energy propellant having a rapid burning rate. A composition having particular utility for the purpose is that disclosed and claimed in the copending application of Graham Shaw bearing Ser. No. 463,355, filed Feb. 2, 1983 for IGNITER PROPELLANT, and assigned to the assignee of the present invention. That composition includes the following ingredients in substantially the proportions indicated below and also has the indicated casting properties:

| Ingredient | Percentage By Weight |
|---|---|
| Hydroxyl Terminated Polybutadiene | 12.7% |
| Acrylonitrile-Glycidol | 0.3 |
| Iron Oxide | 3.0 |
| Aluminum Powder | 10.0 |
| Ammonium Perchlorate (200 micron) | 33.0 |
| Ammonium Perchlorate (3.2 micron) | 40.0 |
| Octadecyl Isocyanate | 0.1 |
| Isophorone diisocyanate | 0.9 |
| | 100.0% |

| Casting Properties | |
|---|---|
| End-O-Mix Viscosity | 3.2 kilopoise |
| Pot Life | 6.5 hours |

When it is desired to ignite the propellant 16 in the rocket motor 10, the initiators 40 and 42 are fired by an externally initiated, confined detonating fuze 46. This activates the through bulkhead initiator 46 and lead 44 which, in turn, ignite the booster charges in the initiators 40 and 42. The resulting hot flaming gases ignite the propellant wafers 32, 34 and 36 producing hot flaming gases which are projected onto the surface of the rocket motor propellant 16 through the rows of nozzle ports 48.

Although not illustrated, the nozzle ports 48 are normally covered with tape such as mylar, vinyl, or aluminum, which tape contains the gas pressure within the cylinder case 24 until the gas pressure is sufficiently high to ignite the rocket motor propellant 16 effectively. The resulting flaming gases are then forced through the nozzle ports 48 over the surface of the motor propellant grain 16 with a component of flow in the direction of the mounting foot 26 for case 24.

The igniter 12 is consumed by combustion of the rocket motor propellant 16 before the propellant 16, at the location of attachment of the igniter 12 thereto, becomes so eroded that the igniter 12 is no longer bonded thereto, and becomes detached therefrom.

Figure 4:
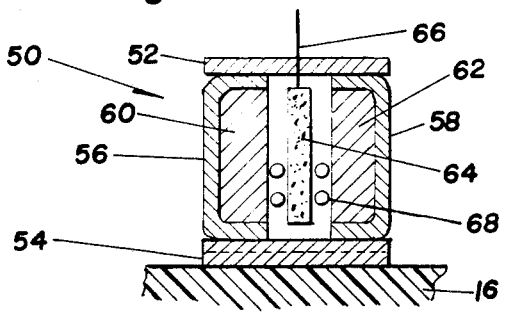
FIG. 4 is a cross-sectional view of a second embodiment of the invention.

In FIG. 4 there is illustrated a second embodiment of the invention comprising a shortened version of the wafer igniter, according to the invention. Thus, in FIG. 4 there is provided an igniter 50 comprising a cylindrical case 52, that may be made of urethane or other suitable consumable material, and has a foot 54 that may be suitably bonded to the surface of the rocket motor propellant 16. Cup-shaped urethane closures or end caps 56 and 58 are bonded to the opposite ends of the case 52.

Contained within the case 52 are two spaced propellant discs or wafers 60 and 62 with wafer 60 positioned within and conforming to the shape of the end caps 56 and the wafer 62 positioned within and conforming to the shape of the end cap 58, being bonded thereto. Propellant wafers 60 and 62 may be made of the same material as that of which propellant wafers 32, 34 and 36 are made, as described herein before.

A tube initiator 64 which may be identical to each of the initiators 40 and 42 of FIG. 2 is positioned within case 52 intermediate the propellant wafers 60 and 62, being held in position by any suitable means, not shown. Hivelite lead 66 that may be identical to the lead 44 of FIG. 2 may be provided, as shown in FIG. 4, for activating the tube initiator 64 of FIG. 4.

Figure 5:
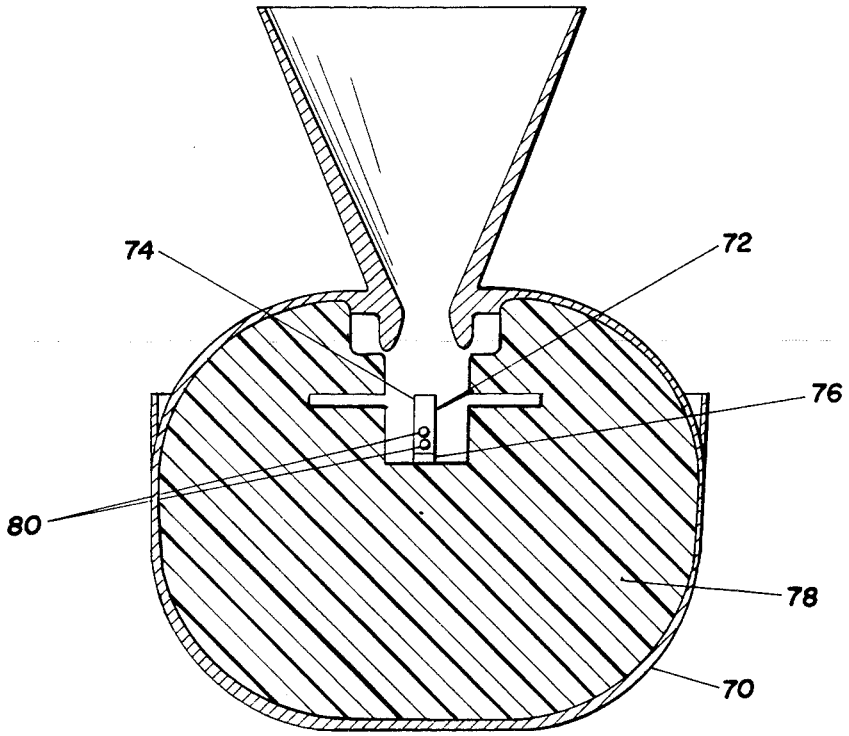
FIG. 5 is a schematic cross-sectional view showing a single wafer igniter, according to the invention, installed in a fully loaded rocket motor.
Figure 6:
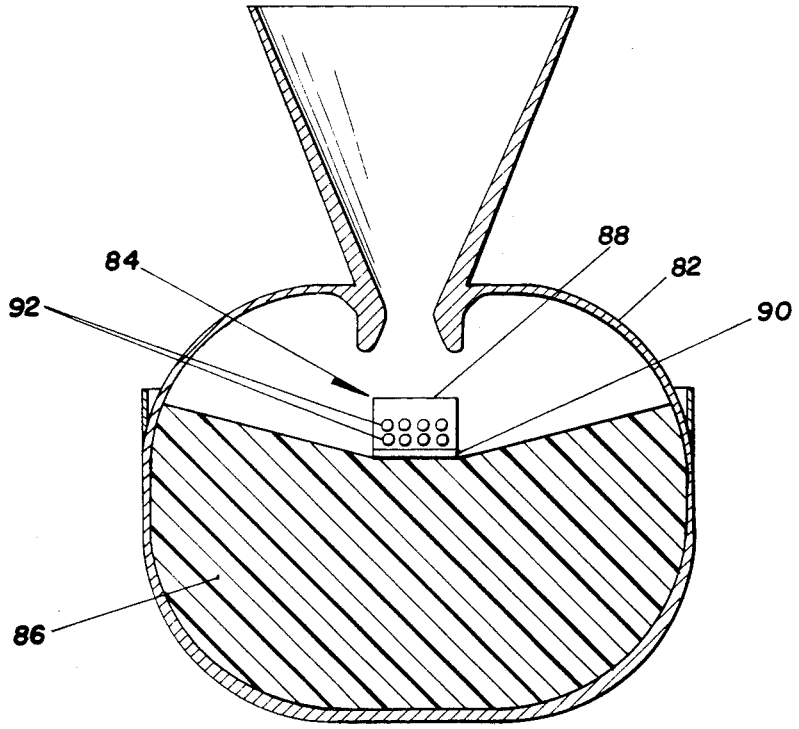
FIG. 6 is a schematic cross-sectional view showing an extended or elongated multiple wafer igniter, according to the invention, installed in an offloaded rocket motor.

Cylindrical case 52 is formed with a plurality of nozzle ports or perforations 68 in the third and fourth quadrants of the case 52, the quadrants adjacent the surface of propellant 16. For convenience of illustration, only two such nozzle ports 68 are shown in FIG. 4, each port 68 facing an open area in the case 52, in the region between the tube initiator 64 and the propellant wafers 60 and 62. The nozzle ports 68 of igniter 50, similar to the nozzle ports 48 of the igniter 12, may be covered with aluminum tape to contain the gas pressure within the cylinder case 52 until the gas pressure is sufficiently high to ignite the rocket motor propellant 16 effectively. The flaming gases that result are then forced through the ports 68 and projected across the surface of the propellant 16 to ignite the latter.

Where a rocket motor 70 having a semi-submerged nozzle such as the nozzle 18 of FIG. 1 is fully loaded, as schematically illustrated in FIG. 5, an even shorter version of the wafer igniter of the present invention may be employed. Thus, by reference to FIG. 5, it is contemplated that the igniter 72 there shown may comprise a single wafer propellant and a single associated tube initiator. The wafer propellant and initiator are contained within a urethane cylindrical case 74 having a foot 76 that may be suitably bonded to the surface of the rocket motor propellant 78. In such a shortened version of the initiator, the propellent wafer may be contained within and conform to the shape of one of the urethane closures or end caps associated with the cylindrical case 74, and the tube initiator may be positioned within the other one of the end caps, being suitably held therein. Cylindrical case 74 is formed with a plurality of nozzle ports 80 in the third and fourth quadrants thereof, with each of the ports 80 facing an open area in case 74 between the initiator and the propellant wafer.

Where a rocket motor 82 having a semi-submerged nozzle such as the nozzle 18 of FIG. 1 is offloaded, as schematically illustrated in FIG. 6, an extended wafer igniter 84 including multiple propellant wafers, for example, three or more wafers, may be employed. In FIG. 6 the rocket propellant 86 is shown having been cut back to meet the requirements of a specific mission. Igniter 84 includes a urethane cylindrical case 88 having a foot 90 that is suitably bonded to the surface of the propellant 86 of the motor 82. Of the three or more propellant wafers contained in the cylindrical case 88, two will be positioned within the urethane end caps or closures associated with the case 88. The remaining propellant wafers are concentrically positioned at uniformly spaced intervals between the end propellant wafers. A urethane tube initiator is positioned between each of the adjacent pairs of propellant wafers, being suitably held in position. Each of the three or more intermediate propellant wafers may be formed with a plurality of uniformly distributed perforations to produce the burning surface required for supporting a specific, desired mass flow rate. Cylindrical case 88 may be formed with a plurality of nozzle ports 92 that are positioned in two parallel, longitudinal rows in each of the third and fourth quadrants of the cylindrical case 88, with each of the ports 92 facing an open area within the case 88 between the multiple propellant wafers.

Thus, there has been provided a wafer igniter that may be readily modified by being extended or shortened to meet the specific requirements of offloaded or fully loaded solid propellant rocket motors. The extendible wafer igniter, in each of the disclosed embodiments, is characterized in that the internal pressure thereof does not try to pull the igniter off the surface of the rocket motor propellant to which it is bonded. This is because the igniter internal pressure is not dependant on the bond of the foot thereof to the rocket motor propellant.

The extendible wafer igniter according to the invention is further characterized in that the basic shape thereof is the same in both the unpressurized and the presurized states. Additionally, the operating pressure, the loads on the case bonds, the propellant bonds, and all of the structural parts of the wafer igniter remain the same, independent of mass flow.

A further and significantly important characteristic of the extendible wafer igniter, according to the invention, is that the igniter internal volume can easily be selected as required to eliminate the L* instability which has caused extinguishment of prior art wafer igniters when fired in a large vacuum chamber. Such selection may be achieved by selecting the length of the cylindrical case to provide an internal volume that is sufficient to accommodate the desired or required number of wafer propellants and associated tube initiators, the wafer propellants all being positioned with the axes thereof oriented substantially coincident with the axis of the cylindrical case, and also to avoid oscillation in the rate of burning of the wafer propellants when the wafer igniter is fired in a large vacuum chamber, as in vacuum space.

What is claimed is:

1. A wafer igniter for projecting a stream of flaming gases onto the surface of the propellant grain of a rocket motor thereby to ignite said propellant grain comprising, a cylindrical case, said case being closed at its ends and having an external foot that extends longitudinally of the case and being adapted to be bonded to the surface of the rocket motor propellant grain, at least one propellant wafer positioned in said cylindrical case with the axis thereof oriented substantially coincident with the axis of said case, at least one tube initiator positioned in said cylindrical case in spaced relation with said wafer propellant, said cylindrical case having a plurality of perforations in the periphery thereof, said perforations being in the quadrants of said case adjacent said foot whereby, upon actuation of said initiator and burning of said propellant wafer, flaming gases are projected in a stream from said perforations with a flow component in the direction of said foot.

2. A wafer igniter as specified in claim 1 wherein said propellant wafer is perforated to provide extra surface area for better burning.

3. A wafer igniter as specified in claim 2 wherein said cylindrical case, said external foot and said initiator are made of material that is consumed upon ignition and burning of the rocket motor propellant grain.

4. A wafer igniter as specified in claim 3 wherein said cylindrical case, said external foot and said initiator are made of urethane.

5. A wafer igniter as specified in claim 3 wherein said cylindrical case is made of an aramid polymer fiber filament.

6. A wafer igniter as specified in claim 1 including a first end cap for closing one end of said cylindrical case and a second end cap for closing the other end thereof, including a first propellant wafer positioned in said first one of said end caps and a second propellant wafer positioned in said second one of said end caps, and wherein said tube initiator is positioned between said first and second propellant wafers in spaced relation therewith.

7. A wafer igniter as specified in claim 6 wherein at least some of the perforations in the periphery of said cylindrical case face an open region internally thereof between said wafer propellants and said tube initiator.

8. A wafer igniter as specified in claim 1 including a first end cap for closing one end of said cylindrical case and a second end cap for closing the other end thereof, including a first propellant wafer positioned in said first one of said end caps, a second propellant wafer positioned in said second one of said end caps, and a third propellant wafer positioned between said first and second propellant wafers in spaced relationship therewith, said third propellant wafer being perforated, and including a first tube initiator positioned between said first and third propellant wafers in spaced relationship therewith, and a second tube initiator positioned between said second and third propellant initiators in spaced relationship therewith.

9. A wafer igniter as specified in claim 8 wherein at least some of the perforations in the periphery of said cylindrical case face an open region internally thereof between said wafer propellants and said tube initiators.

10. A wafer igniter as specified in claim 1 wherein the length of said cylindrical case is selected to provide an internal volume that is sufficient to accommodate a desired number of wafer propellants and associated tube initiators, all of which wafer propellants are positioned with the axes thereof oriented substantially coincident with the axis of said case, and also to avoid oscillation in the rate of burning of said propellant wafers when said wafer igniter is fired in a large vacuum chamber.

* * * * *